US005334956A

United States Patent [19]

Leding et al.

[11] Patent Number: 5,334,956

[45] Date of Patent: Aug. 2, 1994

[54] COAXIAL CABLE HAVING AN IMPEDANCE MATCHED TERMINATING END

[75] Inventors: Lisa M. Leding, Palatine; John M. Tischer, Streamwood, both of Ill.

[73] Assignee: Motorola, Inc., Schaumburg, Ill.

[21] Appl. No.: 860,481

[22] Filed: Mar. 30, 1992

[51] Int. Cl.[5] ..... H01P 3/06

[52] U.S. Cl. ..... 333/33; 333/243; 333/260

[58] Field of Search ..... 33/243, 245, 260, 33; 174/21 C, 28, 36, 74 R, 75 C, 88 C

[56] References Cited

U.S. PATENT DOCUMENTS 2,904,619 9/1959 Forney, Jr. ..... 174/75 C X
3,671,662 6/1972 Miller et al. ..... 174/28

FOREIGN PATENT DOCUMENTS 214513 9/1991 Japan ..... 174/28

*Primary Examiner*—Benny T. Lee

*Attorney, Agent, or Firm*—Timothy W. Markison

[57] ABSTRACT

A coaxial cable that includes a first inner conductor, a first dielectric material that encircles the first inner conductor and a first outer conductor that encircles both the first dielectric material and the first inner conductor is improved to comprise a second inner conductor, a second dielectric material, and a second outer conductor. The second inner conductor has a diameter that is larger than the diameter of the first inner conductor and is electrically coupled to the first inner conductor. The geometric shape of the second dielectric material and the second outer conductor, from an axial perspective, is in the range of an ellipse having an eccentricity in a range greater than zero and less than one to an elongated circle. In addition, the dielectric constant of the second dielectric material is less than the dielectric constant of the first dielectric material such that when the second inner conductor is deflected from the center, the characteristic impedance of the coaxial cable remains substantially the same.

6 Claims, 1 Drawing Sheet

*Axial Prespective*

*Radial Prespective*

Axial Prespective

Radial Prespective

COAXIAL CABLE HAVING AN IMPEDANCE MATCHED TERMINATING END

FIELD OF THE INVENTION

This invention relates generally to coaxial cables and in particular to an improved coaxial cable termination.

BACKGROUND OF THE INVENTION

Coaxial cables are known to comprise an inner conductor, a dielectric material, and an outer conductor. The outer conductor comprises a conductive material that encircles both the inner conductor and dielectric material. Electrically, the outer conductor shields the inner conductor that is carrying an electrical signal such that electromagnetic interference (EMI) radiated from the coaxial cable is at a minimum. The dielectric material, which encircles the inner conductor, electrically isolates the inner conductor from the outer conductor and is selected based on the characteristic impedance desired for the coaxial cable.

As is also known, the coaxial cable is used to electrically couple high frequency signals from one circuit to another. There are several ways to connect, or terminate, a coaxial cable to one of the circuits. For example, the termination may be a locking coupler, press fit, etc. When the coaxial cable is terminated in a press fit manner, i.e. the inner conductor is pressed up against a terminal, the characteristic impedance of the coaxial cable may change. The characteristic impedance changes because the inner conductor is displaced from the center of the dielectric material and the outer conductor. Therefore a need exists for an improved termination that allows the inner conductor to deflect from center without substantially changing the characteristic impedance of the coaxial cable.

SUMMARY OF THE INVENTION

These needs and others are substantially met by the improved coaxial cable disclosed herein. The improved coaxial cable includes a first inner conductor, a substantially circular first dielectric material that has a first dielectric constant, and a substantially circular first outer conductor. From an axial perspective, the first circular dielectric material encircles the inner conductor and the circular outer conductor encircles both the dielectric material and the inner conductor. The coaxial cable is improved to comprise a second inner conductor, a second dielectric material that has a second dielectric constant, and a second outer conductor.

The second inner conductor has a diameter larger than the diameter of the first inner conductor and is electrically coupled to the first inner conductor. The second dielectric material substantially encircles the second inner conductor and from an axial perspective, has a geometric shape in the range from an ellipse having an eccentricity in a range greater than zero and less than one to an elongated circle having a first radius, a second radius, a first center point of the first radius, a second center point of the second radius, and a distance that separates the first center point from the second center point. In addition, the first radius and the second radius are substantially equal and the first center point and the second center point are substantially collinear. The first dielectric constant is greater than the second dielectric constant.

The second outer conductor is electrically coupled to the first outer conductor and, from an axial perspective, encircles the second dielectric material and the second inner conductor. From an axial perspective, the second outer conductor has a geometric shape in the range of an ellipse having eccentricity in a range greater than zero and less than one to an elongated circle having a first radius, a second radius, a first center point of the first radius, a second center point of the second radius, and a distance that separates the first center point from the second center point. The first radius and the second radius are substantially equal and the first center point and the second center point are substantially collinear.

DESCRIPTION OF A PREFERRED EMBODIMENT

Generally, the present invention provides an improved coaxial termination. This is accomplished by shaping a termination end of the outer conductor and the dielectric material into an elliptical shape, such that the inner conductor can move allowing for a pressure contact to be made without substantially changing the characteristic impedance. The geometric shape of the outer conductor and the dielectric material may also be an elongated circle large enough to allow the inner conductor to move.

Figure 1:
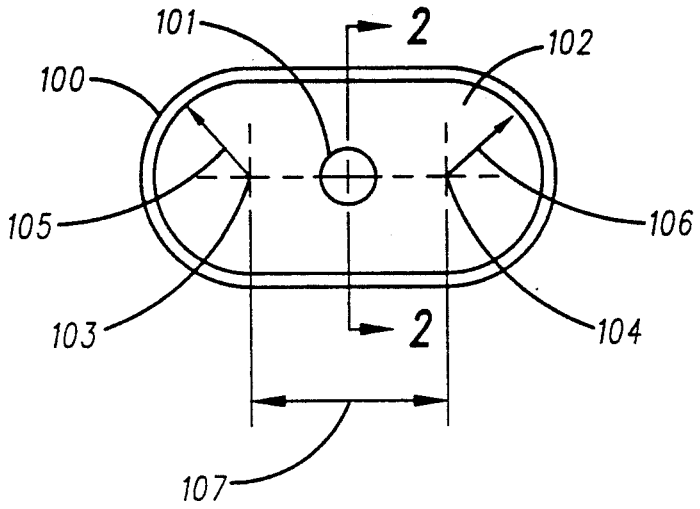
FIG. 1 illustrates, from an axial perspective, a coaxial cable in accordance with the present invention.

The present invention can be more fully described with reference to FIGS. 1 and 2. FIG. 1 illustrates, from an axial perspective, an RF coaxial cable that comprises a second outer conductor 100, a second inner conductor 101, a second dielectric material 102, a first center point 103, a second center point 104, a first radius 105, a second radius 106, and a distance 107. The second dielectric material 102 encircles, or surrounds the second inner conductor 101 and has a geometric shape of an elongated circle. Similarly, the second outer conductor 100 surrounds the second dielectric material 102 and the second inner conductor 101 and also has a geometric shape of the elongated circle. The elongated circle is defined by a first semi-circle, a second semi-circle and a pair of parallel lines that have a length equal to the distance 107. The first and second semi-circles are defined by the first radius 105, the first center point 103 of the first radius 105, the second radius 106, the second center point 104 of the second radius 106 and the distance 107. The first and second radii 105 and 106 have substantially the same dimension and the first and second center points 103 and 104 are substantially collinear and separated by the distance 107.

In the alternative, the second dielectric material 102 and the second outer conductor 100 may have the geometric shape of an ellipse, as graphically depicted by the elongated circle shown in FIG. 1. The elliptical shape will have an eccentricity in a range greater than zero and less than one. As with the elongated circle shape, the second outer conductor 100 encircles , or surrounds the second inner conductor 101 and the second dielectric material 102.

Figure 2:
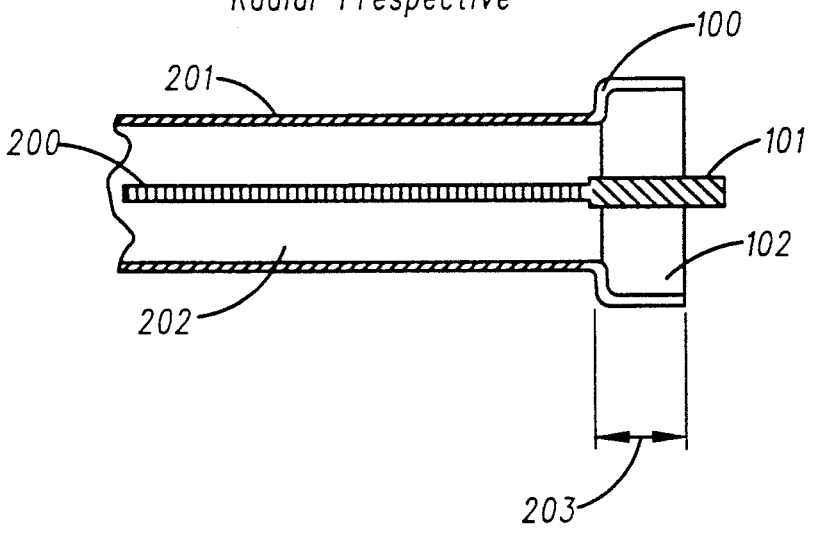
FIG. 2 illustrates a cross-sectional drawing of the coaxial cable, from a radial perspective, in accordance with the present invention.

FIG. 2 illustrates, from a radial perspective or a longitudinal direction, the second inner conductor 101, the second dielectric material 102, and the second outer conductor 100 being coupled to a standard coaxial cable such as an RG142 RF coaxial cable. The standard RF coaxial cable comprises a first inner conductor 200, a circular first dielectric material 202, and a circular first outer conductor 201, wherein, from an axial perspective, the circular first dielectric material 202 encircles the first inner conductor 200 and the first outer conductor 201 encircles the first dielectric material 202 and the first inner conductor 200. The dielectric constant of the first dielectric material 202 is greater than the dielectric constant of the second dielectric material 102. For example, the second dielectric material 102 may comprise air having a relative dielectric constant of 1, while the relative dielectric constant of the first dielectric material is greater than 1.

To construct the RF coaxial cable, the second inner conductor 101, which has a larger diameter than the first inner conductor 200, is electrically coupled to the first inner conductor 200. The electrical coupling may be done by soldering the first inner conductor 200 inside a hole bored axially into the second inner conductor 101. The diameter of the hole will vary depending on the gauge of wire used for the first and second inner conductors. While the first inner conductor is being electrically coupled to the second inner conductor, the second outer conductor 100 is electrically coupled to the first outer conductor 201. This electrical coupling may be done by soldering the first outer conductor 201 to the second outer conductor 100, wherein the second outer conductor 100 may comprise a copper piece with the geometric shape, from an axial perspective, of an elongated circle bore thru it.

When the second dielectric material 102 and second outer conductor 100 have, from an axial perspective, an elongated circle shape, the distance 107 is application dependent and will proportionally affect the value of the first radius 105, the second radius 106 and a length 203. The length 203 is the radial dimension of the second dielectric material 102 and the second outer conductor 100. The first radius 105, second radius 106, distance 107, and length 203 may, for example, comprise of the values of 3/32 inch, 3/32 inch, 1/16 inch and 5/16 inch, respectively. Likewise, when the second dielectric material 102 and second outer conductor 100 have, from an axial perspective, an elliptical shape, the eccentricity is application dependent and will proportionally affect the value of the length 203 of the second dielectric material 102 and the second outer conductor 100.

As a working example, ordinary coaxial cable has a characteristic impedance (ZO) that is determined by the approximate formula $Z_0=[60/(e_r)^{\frac{1}{2}}]\ [\ln (d_2/d_1)]$ where $e_r$ represents the dielectric constant of the coaxial cable's dielectric material, $d_1$ represents the diameter of the coaxial cable's center, or inner, conductor, and $d_2$ represents the diameter of the coaxial cable's outer conductor (i.e. the outer diameter of the cable less any sheating). A typical value of characteristic impedance is 50 ohms. The characteristic impedance of the present invention is defined by the first radius 105 and second radius 106, diameter of second inner conductor 101 and the dielectric constant of the second dielectric material 102 surrounding the second inner conductor 101. The characteristic impedance is not strongly dependant upon the location of the second inner conductor 101 between the first center point 103 and the second center point 104. Proper operation relies on the characteristic impedance of the first section (first inner conductor 200, first dielectric material 202 and first outer conductor 201) to match the characteristic impedance of the second section (second inner conductor 101, second dielectric material 102 and second outer conductor 100.) The characteristic impedance of the second section may, for example, comprise of the characteristic impedance of the first section plus or minus 3%. The 3% variation results from the second inner conductor 101 traveling between the first center point 103 and the second center point 104. Maximum frequency of operation is limited to a frequency at which the freespace wavelength is greater than 25 times the length 203. This frequency may, for example, be 1.5 GHz.

The present invention is especially well suited for testing high frequency devices that make RF connection to the outside world by means of soldering the inner conductor (hot) of a coaxial cable to an RF feedthru in the chassis of the device and soldering the outer conductor (ground) of the same coaxial cable to the chassis of the device. Due to mechanical piece part and assembly tolerances, making a temporary RF connection to the device, say for testing, may be difficult. With the characteristic impedance of the present invention remaining relatively constant even though the spatial relationship between the center conductor and the outer conductor may vary, a reliable test connection can be made.

We claim:

1. An improved coaxial cable that includes a first inner conductor, a substantially circular first dielectric material having a first dielectric constant, and a substantially circular first outer conductor, wherein the circular first dielectric material encircles the first inner conductor and wherein the circular first outer conductor encircles the circular first dielectric material and the first inner conductor, wherein the improvement comprises:

a second inner conductor having a diameter larger than a diameter of the first inner conductor and is physically and electrically coupled to the first inner conductor;

a second dielectric material that has a second dielectric constant, wherein the second dielectric material substantially surrounds the second inner conductor, wherein the second dielectric material has a geometric shape of an ellipse having an eccentricity in a range greater than zero and less than one, and wherein the first dielectric constant is greater than the second dielectric constant; and a second outer conductor that is physically and electrically coupled to the first outer conductor, wherein the second outer conductor surrounds the second dielectric material and the second inner conductor, wherein the second outer conductor has a geometric shape of an ellipse having an eccentricity in a range greater than zero and less than one, and wherein the geometric shape of the second outer conductor is substantially identical to the geometric shape of the second dielectric material.

2. In the improved coaxial cable of claim 1, the second dielectric material comprises air.

3. In the improved coaxial cable of claim 1, the second dielectric material, the second inner conductor, and the second outer conductor define at least one termination end of the coaxial cable.

4. In the improved coaxial cable of claim 3, the second inner conductor extends a predetermined distance beyond the second outer conductor along a longitudinal direction.

5. In the improved coaxial cable of claim 1, a length of the second outer conductor and a length of the second dielectric material are substantially equal along a longitudinal direction.

6. An improved coaxial cable that includes a first inner conductor, a substantially circular first dielectric material having a first dielectric constant, and a substantially circular first outer conductor, wherein the circular first dielectric material encircles the first inner conductor and wherein the circular first outer conductor encircles the circular first dielectric material and the first inner conductor, wherein the improvement comprises:

a second inner conductor having a diameter larger than a diameter of the first inner conductor and is physically and electrically coupled to the first inner conductor;

a second dielectric material that has a second dielectric constant, wherein the second dielectric material substantially surrounds the second inner conductor, wherein the second dielectric material has a geometric shape of an elongated circle characterized by a first semi-circle connected to a second semi-circle by a first pair of substantially parallel lines, wherein the first semi-circle is defined by a first radius and a first center point, wherein the second semi-circle is defined by a second radius and a second center point, wherein the first center point and the second point are separated by a distance and are substantially collinear, and wherein the first dielectric constant is greater than the second dielectric constant; and a second outer conductor that is physically and electrically coupled to the first outer conductor, wherein the second outer conductor surrounds the second dielectric material and the second inner conductor, wherein the second outer conductor has a geometric shape of an elongated circle characterized by a third semi-circle connected to a fourth semi-circle by a second pair of substantially parallel lines, and wherein the geometric shape of the second outer conductor is substantially identical to the geometric shape of the second dielectric material.

* * * * *